US008305184B2

(12) United States Patent
Klaube et al.

(10) Patent No.: US 8,305,184 B2
(45) Date of Patent: Nov. 6, 2012

(54) SURGE ARRESTER

(75) Inventors: Hartmut Klaube, Hermsdorf (DE); Hubert Lauritsche, Hermsdorf (DE)

(73) Assignee: Tridelta Uberspannungsableiter GmbH, Hermsdorf (DE)

( * ) Notice: Subject to any disclaimer, the term of this patent is extended or adjusted under 35 U.S.C. 154(b) by 207 days.

(21) Appl. No.: 12/682,447

(22) PCT Filed: Sep. 4, 2008

(86) PCT No.: PCT/EP2008/062797

§ 371 (c)(1),
(2), (4) Date: Apr. 9, 2010

(87) PCT Pub. No.: WO2009/050011

PCT Pub. Date: Apr. 23, 2009

(65) Prior Publication Data

US 2010/0237980 A1 Sep. 23, 2010

(30) Foreign Application Priority Data

Oct. 12, 2007 (DE) ..... 10 2007 048 986

(51) Int. Cl.
*H01C 7/10* (2006.01)

(52) U.S. Cl. ..... 338/21; 361/117; 361/127

(58) Field of Classification Search ..... 338/21; 361/117–120, 127
See application file for complete search history.

(56) References Cited

U.S. PATENT DOCUMENTS

| | | | | | |
|---|---|---|---|---|---|
| 4,262,318 | A | * | 4/1981 | Shirakawa et al. | 361/127 |
| 4,326,232 | A | * | 4/1982 | Nishiwaki et al. | 361/127 |
| 4,812,944 | A | * | 3/1989 | Eberhard et al. | 361/127 |
| 5,363,266 | A | * | 11/1994 | Wiseman et al. | 361/127 |
| 5,912,611 | A | * | 6/1999 | Berggren et al. | 338/21 |
| 6,008,977 | A | * | 12/1999 | Thatcher | 361/127 |

FOREIGN PATENT DOCUMENTS

| | | |
|---|---|---|
| DE | 299 05 311 U1 | 6/1999 |
| DE | 101 04 393 C1 | 4/2002 |
| EP | 0963 590 B1 | 11/2004 |
| WO | WO-2006125753 | 11/2006 |

OTHER PUBLICATIONS

International Search Report based on PCT/EP2008/062797; International Filing Date Sep. 24, 2008; Priority Date Dec. 10, 2007.

* cited by examiner

*Primary Examiner* — Kyung Lee
(74) *Attorney, Agent, or Firm* — McCracken & Frank LLC

(57) ABSTRACT

Surge arrester with a module 1, 3, 9, 25, which comprises a stack of varistor blocks 1, two end armatures, between which the stack of varistor blocks 1 is held, a plurality of reinforcing elements 9, which extend between the end armatures 3 and are fixed to said end armatures, the reinforcing elements 9 surrounding the stack of varistor blocks, and at least one stabilizing disc 25, which is arranged between two varistor blocks 1 in the stack and guides the at least one reinforcing element 9, and with an outer housing 5 with screens, in which outer housing the module is at least partially accommodated. In the case of the surge arrester according to the invention, the outer housing is designed in such a way that the module is accommodated without any gas, liquid or volumes or cavities therebetween. Furthermore, each of the stabilizing discs 25 is arranged in the region of one of the screens 7.

16 Claims, 5 Drawing Sheets

SURGE ARRESTER

The invention relates to a surge arrester with a cage-like design, as is known, for example, from JP 63-312602. Surge arresters are connected between live lines and ground in power supply systems in order, in the event of a surge in the line, to dissipate this surge to ground and thus to protect other components in the power supply system. Such a surge arrester contains a stack of varistor blocks, which is held between two connecting elements. This arrangement is accommodated in an outer housing.

Surge arresters are capable of dissipating surges occurring within the range for which the surge arresters are designed safely and as often as necessary to ground. The varistor blocks, conventionally zinc oxide ceramic elements, have the property that their electrical resistance is voltage-dependent. This means that the varistor blocks are good insulators below a threshold voltage. Above this voltage, however, they are good electrical conductors.

In the case of lightning strike close to an arrester or a flaw in the line in the case of a high-voltage line, it may come to pass that a surge arrester is subjected to a load which is far greater than its design range. This results in a solid-state flashover through the varistor blocks and in irreversible damage to the surge arrester. Given such an event, a large amount of energy becomes free in the surge arrester, which is associated with a very severe increase in temperature and pressure. In order nevertheless to ensure safe operation, it is therefore necessary that no relatively large fragments, either from the outer housing or from the material of the varistor blocks, are flung far even in such an event.

At present, two different concepts as regards the outer housing are conventional. Firstly there are surge arresters with a "tubular design", in which the active components are accommodated in a tube, for example made from ceramic or a dimensionally stable plastic. In this case, a gas volume remains in the interior of the outer housing. The outer housing of these surge arresters is moreover provided with a gas outlet opening, through which the hot plasma can emerge in the event of an overload, as a result of which an increase in pressure in the interior of the outer housing is prevented. In the case of such surge arresters, the outer housing itself generally remains undamaged even in the case of an overload.

Secondly there are surge arresters in which the outer housing is cast or injection-moulded directly around the active components. For this purpose, a high quality plastic, usually silicone, is used, as is described, for example, in EP-0 963 590 B1.

In order to ensure that the varistor blocks are in good contact with one another even in the case of mechanical loads, it is necessary in both cases to keep the stack of varistor blocks together under pressure. One possibility for this which is used both in surge arresters with a tubular design and in those with an outer housing which is attached by injection-moulding is to provide reinforcing elements, generally bars or ropes, preferably glass-fibre-reinforced plastic bars (GFRP bars), which are held under strain on the end armatures. Occasionally, these surge arresters are also referred to as surge arresters with a "cage-type design".

WO 94/14171 or DE 101 04 393 C1 have disclosed inserting supporting plates or stabilizing discs between the varistor blocks which hold the bars of the cage in their position. The surge arresters disclosed in both of these documents are surge arresters with a tubular design in terms of the configuration of the outer housing.

One disadvantage of the surge arresters with a tubular design consists in the fact that discharges can result via the gas volume between the core and the outer housing. In order to avoid this, the ingress of moisture into the gas volume should be prevented. Often, a gas with better insulator properties than air is used. It is also necessary to avoid a situation in which an exchange of the gas with the ambient air or an ingress of moisture occurs. Surge arresters with a tubular design are therefore relatively expensive to produce. Despite these disadvantages, surge arresters with a tubular design are in widespread use in particular at extremely high voltages of several hundred thousand volts, in order that surge arresters with a physical height of several metres are thus possible.

Surge arresters with an outer housing encapsulating them directly by means of injection-moulding do not have an enclosed gas volume, however, which simplifies the construction. In the case of these surge arresters, the hot plasma will locally destroy the outer housing in the case of overload and thus be released to the outside. In order that this takes place without any notable pressure increase in the interior of the surge arrester, it is necessary for the outer housing to be designed to have as thin walls as possible. In addition, a substantial part of the costs in the production of the surge arrester of this design is caused by the material for the outer housing, which is relatively expensive. The aim of a person skilled in the art is therefore to design the outer housing with as little material as possible. Surge arresters of this design have until now been restricted to relatively low voltages, i.e. a few tens of thousands of volts. For higher voltages, a plurality of surge arresters have been connected in series.

In recent years attempts have been made to construct ever larger surge arresters with an outer housing which encapsulates it directly by injection-moulding, with lengths of 2 m or more being conceived. In particular in the case of such large surge arresters, however, bending of the bars of the cage and impairment of the mechanical stability readily take place. Stabilizing measures, such as thicker bars, were disadvantageous since they necessarily resulted in greater wall thicknesses for the outer housing, which is undesirable, as mentioned.

The object of the invention is therefore to provide a surge arrester with a cage-like design and a plastic outer housing which encapsulates it directly by means of injection-moulding, which surge arrester has improved stability without the additional outer housing material needing to be used.

The object is achieved according to the invention by a surge arrester according to claim 1.

Further advantageous configurations of the invention are given in the dependent claims.

The invention will be described below in detail with reference to the attached figures, in which.

Figure 1:
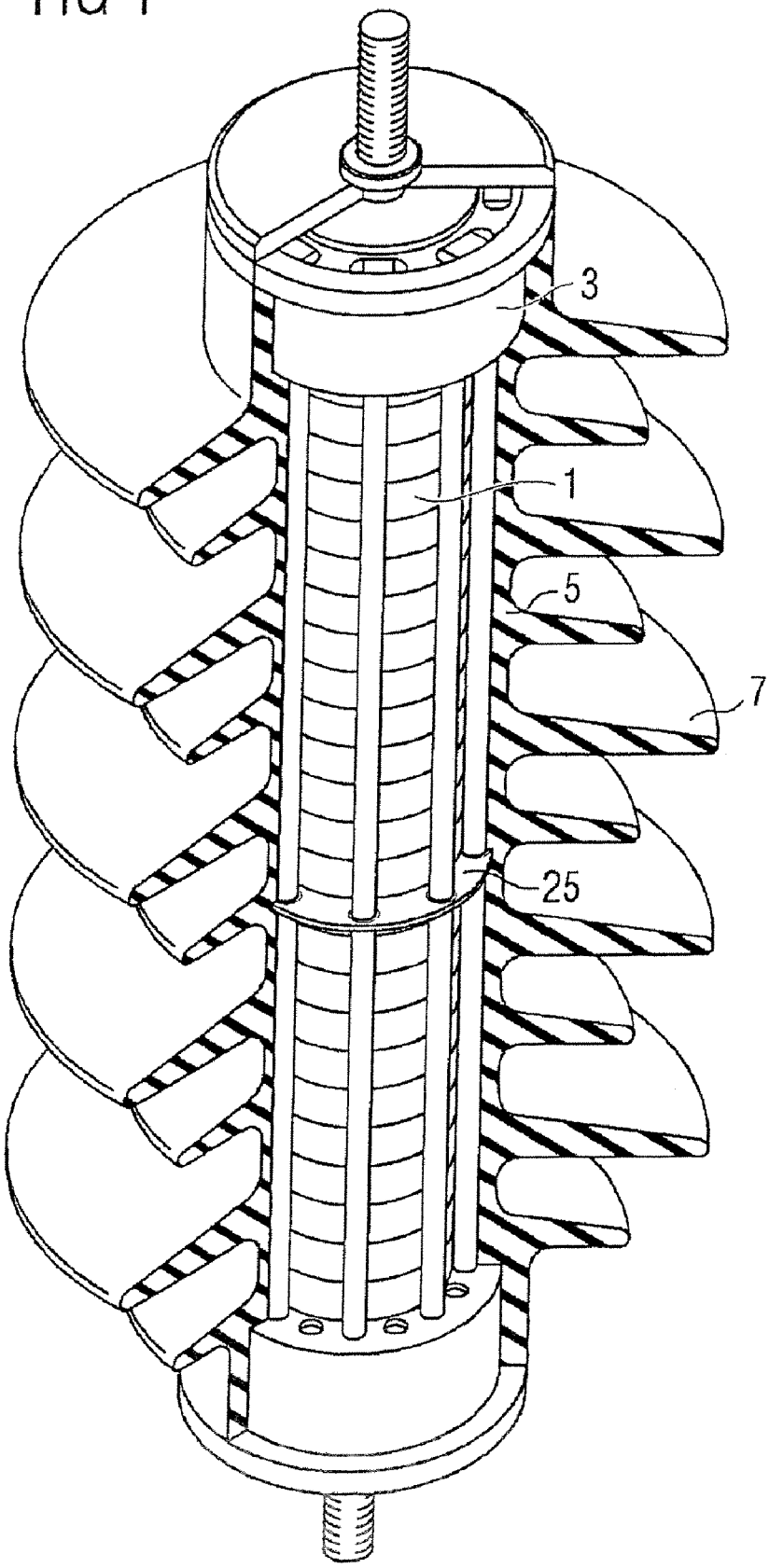
FIG. 1 shows a partial sectional view of a surge arrester according to the invention.

The surge arrester shown in FIG. 1 comprises two connecting blocks or end armatures 3, between which a plurality of arrester blocks, for example varistor blocks 1, are arranged. The varistor blocks 1 are, for example, circular-cylindrical or polygonal. They are generally formed from zinc oxide with corresponding dopings. The varistor material has the property that it has a high electrical resistance below a threshold voltage, while the electrical resistance above this threshold voltage drops considerably. The transition in the case of zinc oxide is very steep. In this way, it is possible to protect other components in a high-voltage network from surges since this surge flows away to ground via the surge arrester.

In order to keep the stack of varistor blocks 1 and the two connecting blocks 3 together, in the surge arrester shown in FIG. 1 reinforcing elements 9 are provided. In the example shown, the reinforcing elements 9 are glass-fibre bars, which are anchored in the two connecting blocks. The anchoring in the connecting blocks can be ensured by wedges, by crimping, by screwing or adhesive bonding or by any other suitable fixing possibility. The connecting blocks 3 are provided with a central screw 4, which is used for connecting the surge arrester to the high-voltage network.

In order to protect against environmental influences, the core thus formed of the surge arrester is equipped with an outer housing 5 with a plurality of screens 7. The outer housing accommodates the varistor blocks without fluid volumes or cavities therebetween.

In the embodiment shown, two different screens 7 are formed along the longitudinal direction of the surge arrester, namely screens with a large diameter 7*a* and those with a small diameter 7*b*. The precise dimensions, spacings and shapes of the screens depend on the intended field of use of the surge arrester. The job of the screens 7 is inter alia to extend the leakage path for the current between the two connection points of the surge arrester and to enlarge the heat-emitting surface of the surge arrester. Although the configuration of the surge arrester with two different screen sizes has proven successful, the invention is not restricted to this configuration. It is possible to equip the surge arrester also with only one screen size, or to provide three or more different screen shapes along a surge arrester.

In practice, it has proven advantageous to set the screens 7 with an angle relative to the longitudinal axis of the surge arrester, an angle of from 5 to 20° being preferred. This design makes it easier for rainwater to flow away when using the surge arrester outdoors.

In order to prevent the ingress of moisture into the interior of the surge arrester, the connecting blocks 3 are also largely accommodated in the outer housing 5 as well and also encapsulated by injection-moulding, as is shown in FIG. 1, with no fluid volumes or cavities therebetween occurring here either.

The silicone material used for the outer housing 5 is a considerable cost factor in the production of surge arresters according to the invention. The outer housing 5 is therefore designed to be as thin as possible. As can be seen in FIG. 1, the diameter of the surge arrester in the region between two screens 7 is smaller than in the region of a connecting block 3.

Aluminium discs (not shown) for improved contact can be inserted between the individual varistor blocks 1. In addition, if required, a spring element can be provided in the stack in order to secure the electrical contact between the varistor blocks 1 and between the varistor blocks 1 and the end armatures 3.

According to the invention, the surge arrester furthermore has one or more stabilizing discs 25, which are arranged between two respective varistor blocks 1.

Figure 5:
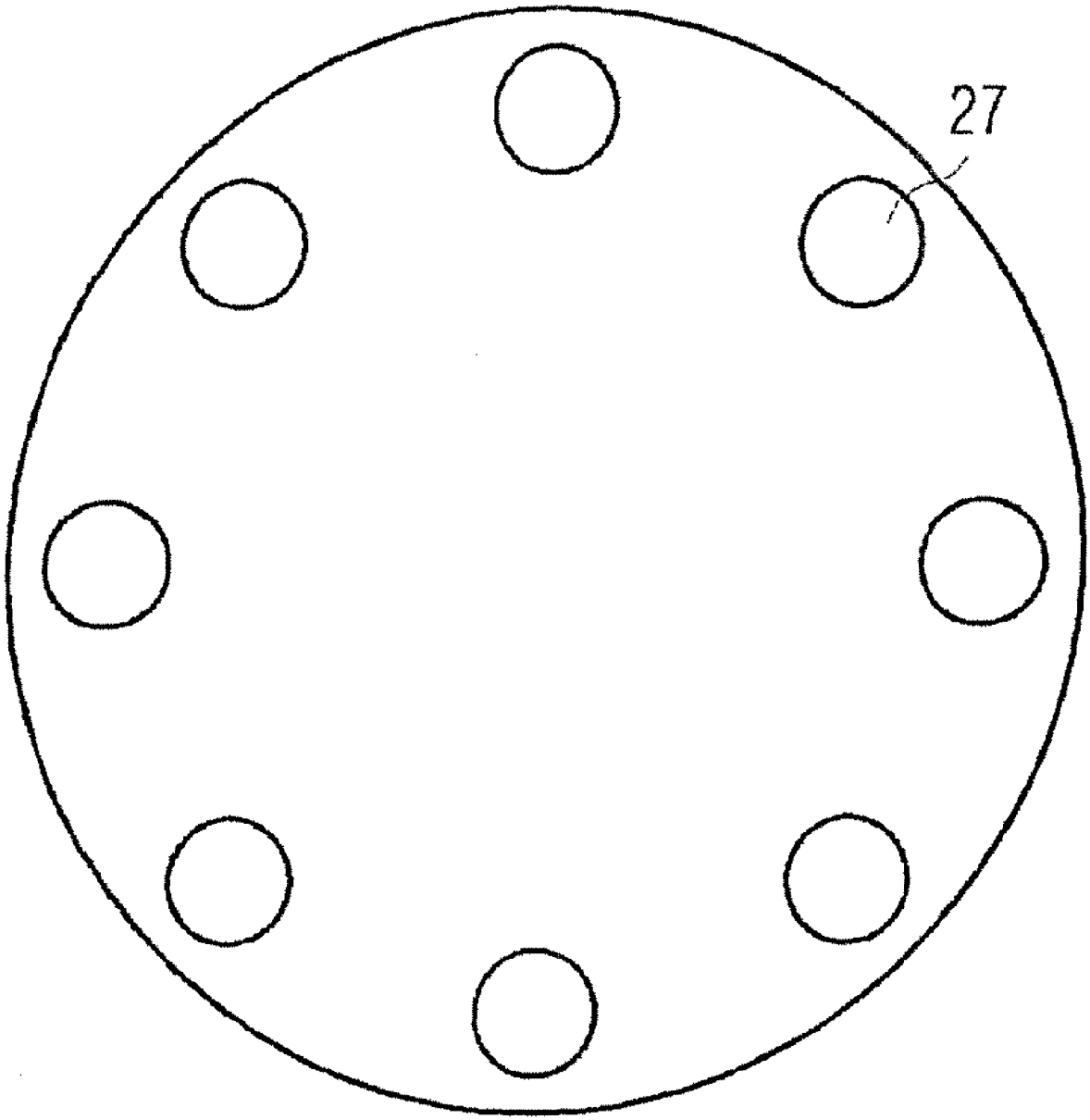
FIG. 5 shows a detail view of a stabilizing disc.

A detailed view of such a stabilizing disc 25 is given in FIG. 5.

The stabilizing disc 25, preferably made from aluminium or another suitable highly conductive material, has a thickness which imparts sufficient stability to it but is also kept as small as possible. In a preferred embodiment of the invention, the stabilizing disc is approximately 5 mm thick.

Along the circumference of the stabilizing disc 25, a number of through-holes 27 are formed, through which the GFRP bars 9 run. The through-holes 27 are at such a great distance from the rim of the stabilizing disc 25 that sufficient stability can be ensured. In the preferred embodiment of the invention, the distance between the rim of each through-hole 27 and the outer circumference of the stabilizing disc 25 is at least 3 mm.

With this design, it is possible to safely and effectively prevent relatively large fragments of varistor blocks 1 from being flung out to the outside through the outer housing 5 in the event of an overload of the surge arrester. In addition, the surge arrester thus produced demonstrates excellent flexural strength and torsional strength, which predestines it for use outdoors, even in the case of very large lengths. In special cases, lengths of 2.5 m or more are possible, with, depending on requirements, a plurality of stabilizing discs 25 being used distributed over the length of the surge arrester.

Figure 4:
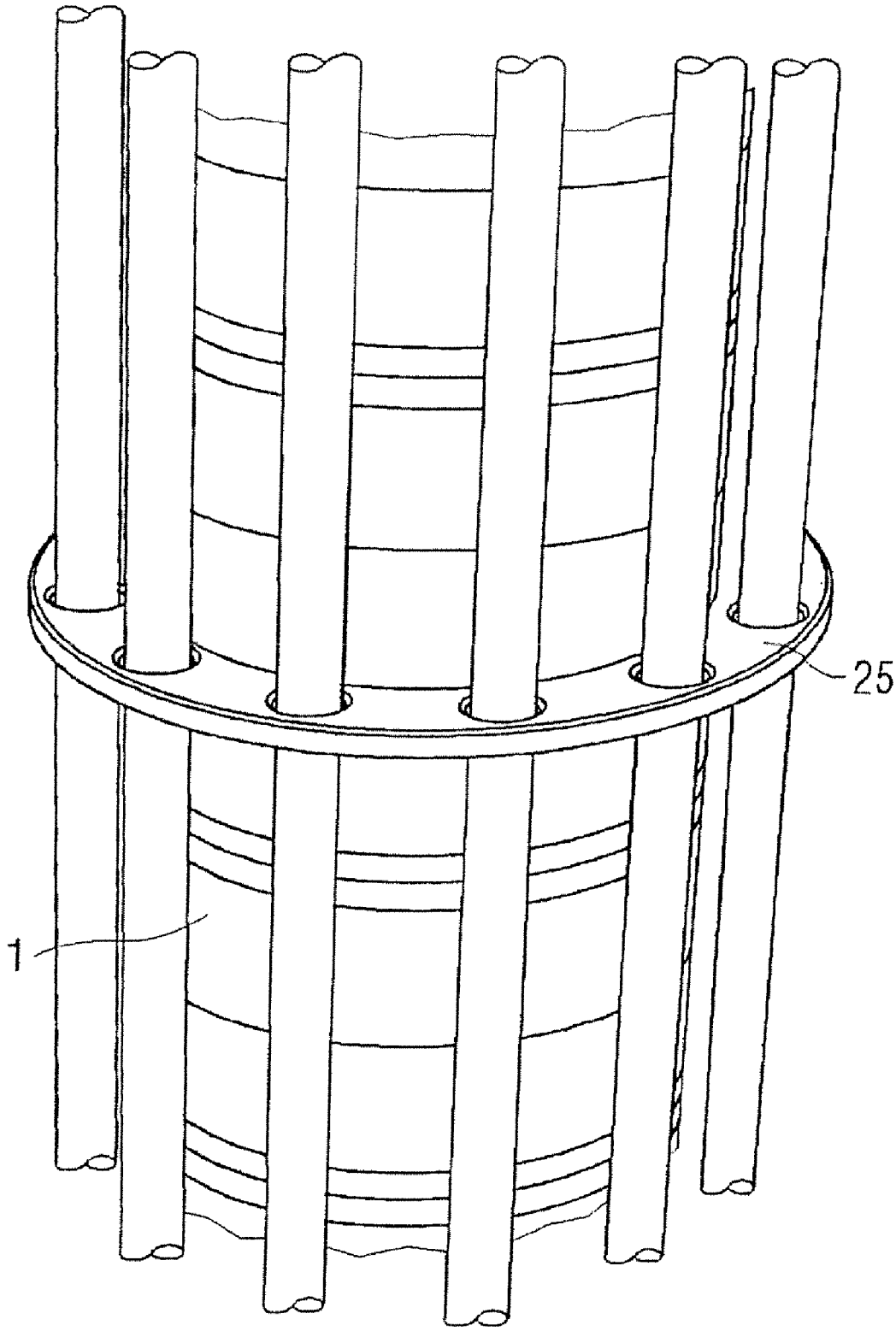
FIG. 4 shows a detail view from FIG. 1.

According to the invention, the stabilizing discs 25 are distributed over the length of the surge arrester in such a way that they are each arranged in the region of one of the screens 7, as is shown in detail in FIG. 4.

Since it is firstly necessary to provide the stabilizing discs 25 with good insulation by means of the outer housing 5, with the result that a degree of coverage of a few millimetres is required, but since secondly the outer housing material, namely usually silicone, is very expensive and it is undesirable to increase the total amount for the surge arrester, the stabilizing disc 25 is, according to the invention, provided in the region of one of the screens 7, where a sufficient degree of coverage with outer housing material is possible without an additional use of material being required.

Figure 2:
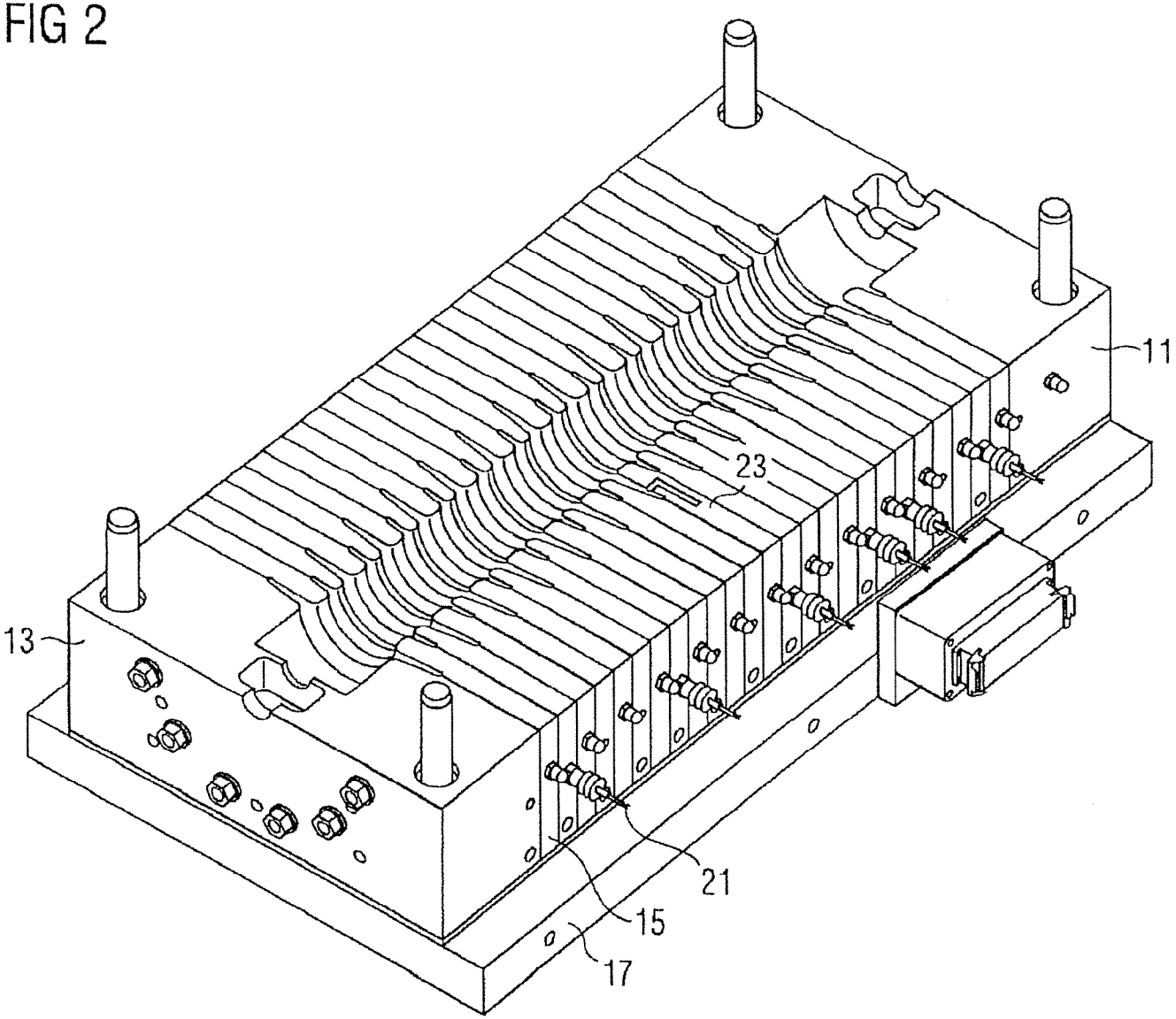
FIG. 2 shows a first half of a mould for producing the housing of the surge arrester according to the invention.
Figure 3:
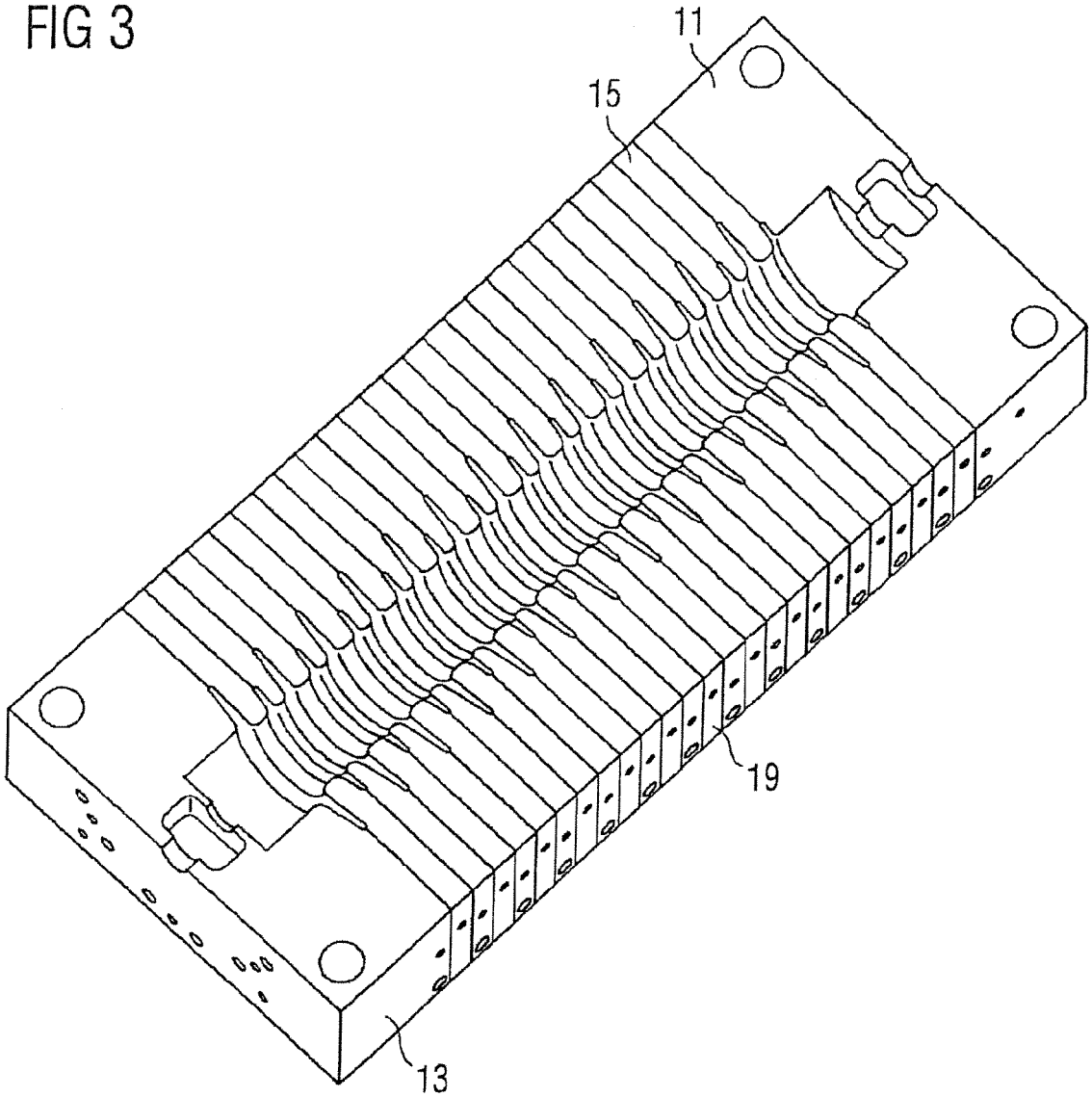
FIG. 3 shows a second half of the mould for producing the housing of the surge arrester according to the invention.

In a preferred embodiment, the surge arrester is produced with a modular mould, as is shown in FIGS. 2 and 3.

The modular mould makes it possible to achieve precise positioning of the stabilizing discs. In particular it is possible to use a special intermediate part 15 for those screens 7 in which a stabilizing disc 25 is provided, which intermediate part 15 makes it possible to safely cover the stabilizing disc with outer housing material.

A method for producing the surge arrester as shown in FIG. 1 is described below.

First, depending on the required dielectric strength of the surge arrester, the required number of varistor blocks 1 is combined. Aluminium contact discs can be interposed between the individual varistor blocks 1 in order to improve the electrical contact between said blocks. In addition, one or more stabilizing discs are inserted into the stack. In order to enlarge the overall length of the surge arrester and therefore the distance between the live line and ground and in order to precisely position the stabilizing discs 25 with respect to the screens 7, spacers consisting of aluminium, which substantially correspond in terms of their shape to the varistor blocks 1, can moreover be provided. Furthermore, two end armatures 3 are provided. A stack is formed from the end armatures 3, the varistor blocks 1, the stabilizing discs 25 and possibly the spacers and contact discs.

In addition, if required plate springs or further elements can be added to the stack.

In the embodiment shown, glass-fibre-reinforced plastic bars 9 are then arranged and clamped between the end armatures 3 in order to keep the stack of varistor blocks 1 and end armatures 3 together under strain. The core thus formed is inserted into a mould shown in FIG. 2.

The mould shown in FIG. 2 has a modular design and comprises a top part 11 and a base part 13, which each correspond to the two end armatures 3. A selectable number of intermediate parts 15 is provided between the top part 11 and the base part 13, with the result that, overall, a modular mould is produced.

All of the parts together are fixed on a mounting or base plate 17. The mounting plate 17 is provided with a grid design, with the result that the distance between the top part 11 and the base part 13 can be set, with the result that a variable number of intermediate parts 15 can be inserted.

The intermediate parts 15 contain the heating elements (not shown) required for the filling and wetting process of the silicone and cooling and ventilating channels 19 and 21.

In a preferred embodiment, the heating elements and cooling channels 19 of the individual intermediate parts 15 are equipped with connections, which are also accessible from the outside when the mould is assembled. In this way, it is possible for the heating elements or the cooling channels to be interconnected, which allows for targeted, spatially different and possibly also time-dependent heat treatment of the individual sections of the mould and can thus positively influence the wetting process of the silicone.

The intermediate parts 15 touch one another along the circumferential edge of a screen 7 of the outer housing 5. In other words, if the upper side of a screen 7 is formed by a first intermediate part 15, the lower side of the same screen 7 is formed by the next-following intermediate part 15. A seam, which is formed during casting along the transition line between the two intermediate parts 15, therefore coincides with the outer circumference of the screen 7.

FIG. 3 shows the corresponding opposing piece for the mould half shown in FIG. 2. In order to form the surge arrester, the mould parts shown in FIG. 2 and are assembled once the core has been inserted and fixedly connected to one another by means of a closing apparatus. Then, the silicone elastomer is injection-moulded in under pressure and wetted with the supply of heat. The individual parameters of this wetting process, such as the optimum temperature, the required pressure or the flow speeds, depend on the plastic material selected and are known to a person skilled in the art. For example, a temperature of from 50 to 300°, preferably 80-150° C., and a pressure of from 1 to 20 bar can be selected.

After the wetting operation of the silicone, the mould is again separated into the two halves shown in FIGS. 2 and 3 and the surge arrester is removed. Since the silicone is still relatively elastic even in the cured state, the screens detach without any problems from the recesses which are formed by the mould.

As is shown in FIGS. 2 and 3, an intermediate part 23 which is especially provided for the injection-moulding is provided at least in one of the two mould halves. In order to avoid visible injection-moulding points in the silicone housing, it is preferred to position this injection-moulding point in such a way that it is formed on the lower side of a screen 7.

The modular mould shown in FIGS. 2 and 3 makes it possible to set the length of the surge arrester in a very flexible manner, without new moulds needing to be produced. For this purpose, it is sufficient to remove individual intermediate parts 15 from the mould and to shorten them correspondingly or insert further intermediate parts 15. The mould furthermore allows for a large degree of flexibility as regards the precise shaping of the connecting blocks since different diameters to these sections of the surge arrester can also readily be realized simply by exchanging the top part 11 and the base part 13.

A further advantage of the production method described is that different screen shapes or screen sequences are possible, in particular special screens can be provided where stabilizing discs 25 are arranged.

In principle, the invention is not restricted to the production of surge arresters with varistor blocks. It is likewise possible to produce the surge arresters with a spark gap using the method according to the invention.

A further advantage of the invention consists in the fact that the intermediate parts 15 of the mould can be produced in a simple and inexpensive manner, for example using a lathe or a milling machine. During assembly, however, recesses are possible which otherwise in integral moulds can only be formed with difficulty, or even not at all.

Further advantageous configurations result for a person skilled in the art when reworking the teaching disclosed herein in an obvious manner. Thus, it is possible, for example, to use a polygonal stabilizing disc instead of a round stabilizing disc, as is known, for example, from WO 94/14171. The use of a multipart stabilizing disc, as is known from DE 101 04 393 C1, is also possible in connection with the teaching according to the invention.

For further stabilization purposes, moreover, it is also conceivable for the glass-fibre-reinforced plastic bars to also be fixed on the stabilizing discs with respect to a movement in the longitudinal direction. This can take place, for example, by means of crimping.

The invention claimed is:

1. A surge arrester, comprising:

a core including a stack of varistor blocks and two end armatures between which the stack of varistor blocks is held;

a plurality of reinforcing elements that extend between the end armatures, that are fixed to the end armatures, and that surround the stack of varistor blocks;

at least one stabilizing disc that is arranged between two varistor blocks in the stack and guides the at least one reinforcing element; and an outer housing having a plurality of screens in which the core is at least partially accommodated;

wherein the outer housing accommodates the core without substantially any fluid volumes or cavities therebetween;

wherein the at least one stabilizing disc is arranged in the region of one of the screens, wherein the plurality of screens of the outer housing are spaced apart with a series of substantially cylindrical portions disposed therebetween, and wherein a thickness of the substantially cylindrical portions is less than a thickness of the outer housing in each area surrounding the end armatures.

2. The surge arrester of claim 1, wherein a plurality of stabilizing discs are distributed in the stack of varistor blocks.

3. The surge arrester of claim 1, wherein the at least one stabilizing disc has a plurality of through-holes through which reinforcing elements run.

4. The surge arrester of claim 3, wherein the at least one stabilizing disc is made from aluminum and has a thickness of from 3 to 10 mm.

5. The surge arrester of claim 3, wherein the rim of the through-holes is spaced apart from the rim of the at least one stabilizing disc by at least 2 to 4 mm.

6. The surge arrester of claim 1, wherein the outer housing is formed from silicone by means of the core being encapsulated by injection-moulding or casting in a mould.

7. The surge arrester of claim 1, wherein the reinforcing elements are fixed in the at least one stabilizing disc by means of crimping.

8. The surge arrester of claim 1, wherein a plurality of stabilizing discs are distributed in the stack of varistor blocks.

9. The surge arrester of claim 8, wherein each stabilizing disc has a plurality of through-holes through which reinforcing elements run.

10. The surge arrester of claim 9, wherein each stabilizing disc is made from aluminum and has a thickness of from 3 to 10 mm.

11. The surge arrester of claim 10, wherein the rim of the through-holes is spaced apart from the rim of the stabilizing disc by at least 2 to 4 mm.

12. The surge arrester of claim 11, wherein the outer housing is formed from silicone by means of the core being encapsulated by injection moulding or casting in a mould.

13. The surge arrester of claim 11, wherein the reinforcing elements are fixed in the stabilizing discs by means of crimping.

14. The surge arrester of claim 4, wherein the rim of the through-holes is spaced apart from the rim of the at least one stabilizing disc by at least 2 to 4 mm.

15. The surge arrester of claim 14, wherein the outer housing is formed from silicone by means of the core being encapsulated by injection-moulding or casting in a mould.

16. The surge arrester of claim 15, wherein the reinforcing elements are fixed in the at least one stabilizing disc by means of crimping.

* * * * *